US012342862B2

(12) United States Patent
Moloney

(10) Patent No.: US 12,342,862 B2
(45) Date of Patent: Jul. 1, 2025

(54) AEROSOL GENERATING SYSTEM

(71) Applicant: Nicoventures Trading Limited, London (GB)

(72) Inventor: Patrick Moloney, London (GB)

(73) Assignee: Nicoventures Trading Limited, London (GB)

( * ) Notice: Subject to any disclaimer, the term of this patent is extended or adjusted under 35 U.S.C. 154(b) by 670 days.

(21) Appl. No.: 17/600,581

(22) PCT Filed: Mar. 18, 2020

(86) PCT No.: PCT/GB2020/050704
§ 371 (c)(1),
(2) Date: Sep. 30, 2021

(87) PCT Pub. No.: WO2020/201703
PCT Pub. Date: Oct. 8, 2020

(65) Prior Publication Data

US 2022/0175033 A1 Jun. 9, 2022

(30) Foreign Application Priority Data

Apr. 5, 2019 (GB) ..... 1904844

(51) Int. Cl.
*A24F 40/42* (2020.01)
*A24F 40/20* (2020.01)
(Continued)

(52) U.S. Cl.
CPC ..... *A24F 40/42* (2020.01); *A24F 40/20* (2020.01); *A24F 40/46* (2020.01); *A24F 40/60* (2020.01)

(58) Field of Classification Search
CPC .... A24F 40/30; A24F 7/00; A24F 7/02; A24F 7/04
See application file for complete search history.

(56) References Cited

U.S. PATENT DOCUMENTS 6,053,176 A 4/2000 Adams et al.
2006/0102175 A1 5/2006 Nelson
(Continued)

FOREIGN PATENT DOCUMENTS

CN 1124445 A 6/1996
CN 204635081 U 9/2015
(Continued)

OTHER PUBLICATIONS

International Search Report and Written Opinion for International Application No. PCT/GB2020/050704, dated Sep. 27, 2019, 14 pages.
(Continued)

*Primary Examiner* — Ross N Gushi
(74) *Attorney, Agent, or Firm* — Merchant & Gould P.C.

(57) ABSTRACT

There is provided an aerosol generating system (100) comprising: an aerosol generating medium (110); a source of energy for heating (120) for selectively heating in a heating zone associated with the source of energy for heating portions of aerosol generating medium to form an aerosol; an outlet (132) through which aerosol can flow to exit the device; and, a selectively moveable element (134), wherein the element is selectively moveable relative to the aerosol generating medium to form a substantially enclosed chamber around the heating zone, and in fluid communication with the outlet.

15 Claims, 5 Drawing Sheets

(51) Int. Cl.
*A24F 40/46* (2020.01)
*A24F 40/60* (2020.01)

(56) References Cited

U.S. PATENT DOCUMENTS

| | | | | |
|---|---|---|---|---|
| 2008/0283057 | A1 | 11/2008 | Rohrschneider et al. | |
| 2017/0258141 | A1 | 9/2017 | Chen et al. | |
| 2018/0289907 | A1 | 10/2018 | Marmur | |
| 2021/0267276 | A1* | 9/2021 | Taurino | A24F 40/44 |
| 2022/0039465 | A1* | 2/2022 | Du | A24F 40/30 |

FOREIGN PATENT DOCUMENTS

| | | | |
|---|---|---|---|
| CN | 106998815 | A | 8/2017 |
| EP | 3025602 | A2 | 6/2016 |
| GB | 1335378 | A | 10/1973 |
| JP | H07147965 | A | 6/1995 |
| JP | 2018528788 | A | 10/2018 |
| JP | 2018529311 | A | 10/2018 |
| KR | 20180014089 | A | 2/2018 |
| KR | 20180044879 | A | 5/2018 |
| RU | 2604022 | C2 | 12/2016 |
| RU | 2637980 | C2 | 12/2017 |
| WO | 9211051 | A1 | 7/1992 |
| WO | WO-2016193705 | A3 | 1/2017 |
| WO | WO 2017/109448 | A2 | 6/2017 |
| WO | WO-2017115182 | A1 | 7/2017 |
| WO | WO 2018/141466 | A1 | 8/2018 |
| WO | 2018190605 | A2 | 10/2018 |
| WO | 2019016740 | A1 | 1/2019 |
| WO | 2019030172 | A1 | 2/2019 |

OTHER PUBLICATIONS

"Decision to Grant received for Japanese Patent Application No. 2021-557818, mailed on Oct. 3, 2023", 5 pages (2 pages of English Translation and 3 pages of Official Copy).

"Examination Report No. 1 received for Australian Patent Application No. 2020253980, mailed on Jun. 30, 2022", 3 pages.

"International Preliminary Report on Patentability received for PCT Patent Application No. PCT/GB2020/050704, mailed on Oct. 14, 2021", 12 pages.

"Notice of Allowance received for Chinese Patent Application No. 202080026571.6, mailed on Nov. 16, 2023", 8 pages (4 pages of English Translation and 4 pages of Official Copy).

"Office Action received for Korean Patent Application No. 10-2021-7031374, mailed on Sep. 21, 2023", 11 pages (6 pages of English Translation and 5 pages of Official copy).

"Office Action received for Russian Patent Application No. 2021128847, mailed on Apr. 20, 2022", 14 pages (5 pages of English Translation and 9 pages of Official Copy).

* cited by examiner

AEROSOL GENERATING SYSTEM

CROSS-REFERENCE TO RELATED APPLICATIONS

This application is a National Phase entry of PCT Application No. PCT/GB2020/050704, filed Mar. 18, 2020, which application claims the benefit of priority to GB 1904844.6 filed Apr. 5, 2019, the entire disclosures of which are incorporated herein by reference.

TECHNICAL FIELD

The present disclosure relates to an aerosol generating system, a method of generating an aerosol in an aerosol generating system, a consumable product for use in an aerosol generating system and an aerosol generating device.

BACKGROUND

Aerosol generating devices are known. Common devices use heaters to create an aerosol from a suitable medium which is then inhaled by a user. In common devices the aerosol generated from the medium may condense within the device. This can result in aerosol condensing on components which may reduce the lifetime of such components.

Various approaches are described herein which seek to help address or mitigate at least some of the issues discussed above.

SUMMARY

Aspects of the disclosure are defined in the accompanying claims.

In accordance with some embodiments described herein, there is provided an aerosol generating system comprising: an aerosol generating medium; a source of energy for heating for selectively heating in a heating zone associated with the source of energy for heating portions of aerosol generating medium to form an aerosol; an outlet through which aerosol can flow to exit the device; and, a selectively moveable element, wherein the element is selectively moveable relative to the aerosol generating medium to form a substantially enclosed chamber around the heating zone, and in fluid communication with the outlet.

In accordance with some embodiments described herein, there is provided a consumable product for use with the aerosol generating system.

In accordance with some embodiments described herein, there is provided aerosol generating means comprising: aerosol generating means; heating means for selectively heating in a heating zone associated with the heating means portions of aerosol generating means to form an aerosol; outlet means through which aerosol can flow; and, a selectively moveable means, wherein the selectively moveable means is selectively moveable relative to the aerosol generating means to form a substantially enclosed chamber around the heating zone, and in fluid communication with the outlet means.

In accordance with some embodiments described herein, there is provided a method of generating an aerosol in an aerosol generating system, the method comprising: providing an aerosol generating medium; providing a source of energy for heating; providing an outlet; providing a selectively moveable element; selectively moving the element relative to the aerosol generating medium to form a substantially enclosed chamber a portion of the aerosol generating medium; and, heating the substantially enclosed chamber to form an aerosol from the portion of aerosol generating medium.

In accordance with some embodiments described herein, there is provided an aerosol generating device configured to receive aerosol generating medium, comprising: a source of energy for heating for selectively heating, in use, portions of aerosol generating medium to form an aerosol; an outlet; and, a selectively moveable element, wherein the element is selectively moveable relative to the aerosol generating medium to, in use, form a substantially enclosed chamber around the heating zone, and in fluid communication with the outlet.

DESCRIPTION OF DRAWINGS

The present teachings will now be described by way of example only with reference to the following figures in which like parts are depicted by like reference numerals.

Figure 1:
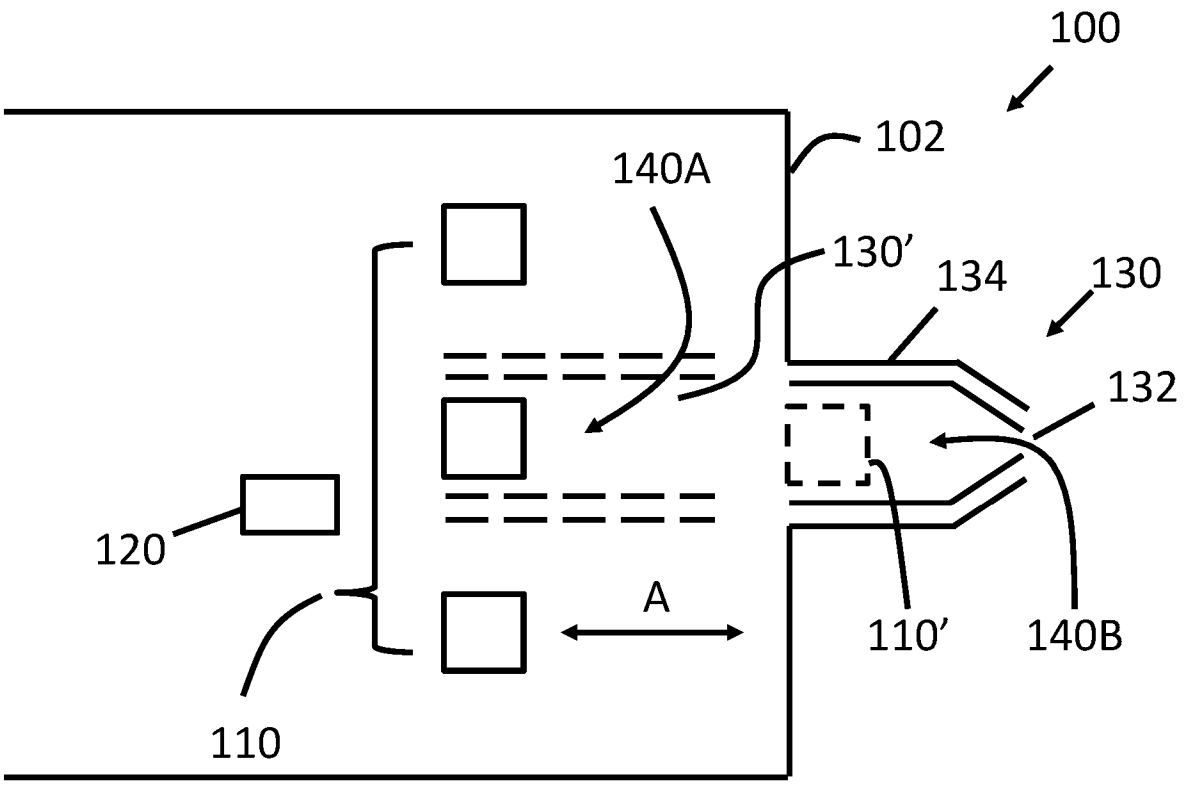
FIG. 1 is a schematic sectional view of a portion of an aerosol generating system according to an example.

While the invention is susceptible to various modifications and alternative forms, specific embodiments are shown by way of example in the drawings and are herein described in detail. It should be understood, however, that the drawings and detailed description of the specific embodiments are not intended to limit the invention to the particular forms disclosed. On the contrary, the invention covers all modifications, equivalents and alternatives falling within the scope of the present invention as defined by the appended claims.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to aerosol provision systems, which may also be referred to as aerosol provision systems, such as e-cigarettes. Throughout the following description the term "e-cigarette" or "electronic cigarette" may sometimes be used, but it will be appreciated this term may be used interchangeably with aerosol provision system/device and electronic aerosol provision system/device. Furthermore, and as is common in the technical field, the terms "aerosol" and "vapour", and related terms such as "vaporize", "volatilize", and "aerosolize", may generally be used interchangeably.

FIG. 1 illustrates a schematic view of a portion of an aerosol generating system 100. The system 100 has a source of aerosol generating medium 110. The system 100 has a source of energy for heating 120 for selectively heating a selected portion of aerosol generating medium 110 to form an aerosol. The source of energy for heating 120 heats a heating zone in which portions of aerosol generating medium are positioned to form an aerosol. The system 100 has an outlet 132 and an element 134. The element 134 is selectively moveable relative to the aerosol generating medium 110 to form a substantially enclosed chamber 140A, 140B around the heating zone, and in fluid communication with the outlet 132. In an example, the outlet 132 and the element 134 are formed as a mouthpiece 130.

As used herein, the term "heater" may be used interchangeably with "source of energy for heating", the term "plurality of sources of aerosol generating medium" or "source of aerosol generating medium" may be used interchangeably with "portions of aerosol generating medium", the term "chamber" may be used interchangeably with "aerosol generation region", and the term "device" may be used interchangeably with "system" with the understanding that the device is a standalone tool while a system is the tool with a consumable.

As used herein, the term "substantially enclosed" may mean that, for example, a certain percentage of the volume of the chamber (or equivalent) is enclosed. This refers to the volume bound by walls of the chamber (or equivalent). This may be between around 50% to around 99%. Alternatively, the volume enclosed may be around 55% or greater, 60% or greater, 65% or greater, 70% or greater, 75% or greater, 80% or greater, 85% or greater, 90% or greater, 95% or greater, etc.

FIG. 1 shows two options for a form that the systems implementing the above principles may take, among others. The components shown in dashed lines indicate a movement from an at-rest position. The dashed-line mouthpiece 130' shows a mouthpiece 130' having been selectively moved relative to the plurality of sources of aerosol generating medium 110 to form an enclosed aerosol generation region 140A around the selected one of the plurality of source of aerosol generating medium 110. The dashed-line source of aerosol generating medium 110' shows a source of aerosol generating medium 110' having been selectively moved relative to the mouthpiece 130 to form an enclosed aerosol generation region 140B. In examples of the device 100, the mouthpiece 130 may move, the sources of aerosol generating medium 110 may move or both may move. In the examples shown in FIG. 1, the movement of the mouthpiece 130' and the source of aerosol generating medium 110' occurs along the axis shown by arrow A. The example of FIG. 1 is schematic only. The mouthpiece 130 is unlikely to move as far into the device 100 as mouthpiece 130' is shown to have moved in the FIG. 1 by virtue of the length of the mouthpiece 130' in FIG. 1 and the housing 102 of the device, to which the mouthpiece 130 is shown to be attached. The figure is used to show clearly the relative movement of the components of the device and the subsequent formation of an enclosed aerosol generation region 140A, 140B. Subsequent figures should be viewed in this light.

In the specification below numerals for the source of aerosol generating medium 110 and source of aerosol generating medium 110' may be used interchangeably. The same may occur for the mouthpiece 130 and mouthpiece 130'. As relative movement is disclosed, the specific movement of one component towards the other, as shown in FIG. 1 with the numerals 110, 110', 130, 130', is not wholly relevant. This numbering convention may, however, be adhered to in certain instances to increase clarity between specific movements. Similarly the numeral for aerosol generation region will be the more general 140, rather than the specific 140A, 140B.

The mouthpiece 130 may be arranged on runners or the like that enable the mouthpiece 130 to be connected to the housing 102 of the device 100 while also being able to be moved into the device 100 by some distance. Maintaining the outlet 132 of the mouthpiece 130 outside the housing 102 of the device 100, during movement of the mouthpiece 130, enables easier use of the device 100 by a user; it is easier for a user to inhale upon a device 100 if the mouthpiece 130 of the device 100 can be placed into the mouth of the user.

Following relative movement of the sources of aerosol generating medium 110 and the mouthpiece 130, the mouthpiece 130 forms an enclosed aerosol generation region 140 around a selected one of the plurality of sources of aerosol generating medium 110. That is to say, the mouthpiece 130 is selectively moveable relative to the plurality of sources of aerosol generating medium 110 to form an enclosed aerosol generation region 140 around the selected one of the plurality of sources of aerosol generating medium 110 as it is heated and not the other sources of aerosol generating medium 110. This is as shown in FIG. 1. The enclosed aerosol generation region 140 restricts generated aerosol from passing into an airspace that is not in the formed channel between the selected source of aerosol generating medium 110 and the mouthpiece 130.

Figure 2A:
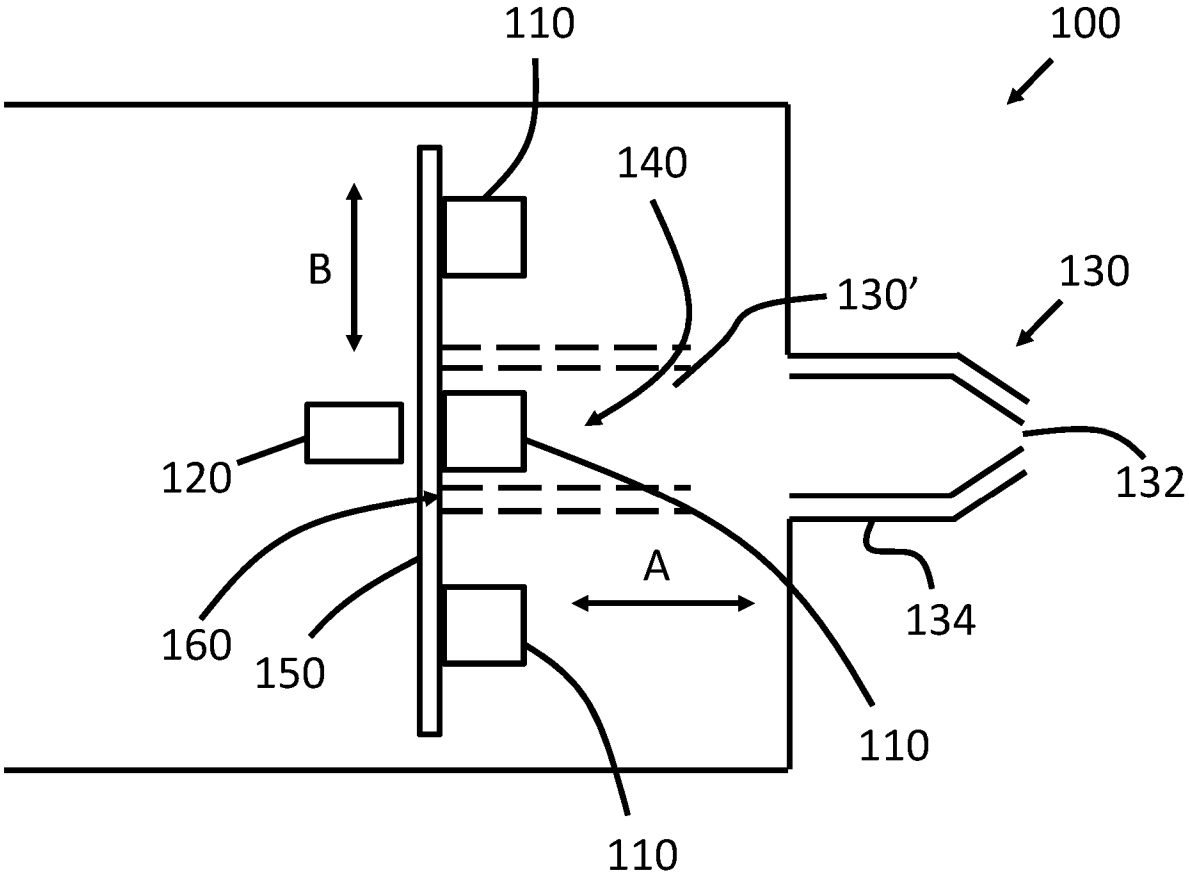
FIG. 2*a* is a schematic sectional view of a portion of an aerosol generating system according to an example.

FIG. 2*a* is a schematic sectional view of a portion of an aerosol generating device 100 according to an example. Reference numerals indicating the same features as shown in FIG. 1 are the same as those numerals used in FIG. 1. These same features will not be discussed in detail here. The plurality of sources of aerosol generating medium 110, in the example of FIG. 2*a*, is arranged on a substrate 150. The mouthpiece 130 may be selectively moved relative to the plurality of sources of aerosol generating medium 110 to form a pressed seal 160 around the selected one of the plurality of sources of aerosol generating medium 110 on the substrate 150. The pressed seal 160 may assist in restricting generated aerosol from passing into an airspace that is not in the formed channel between the selected source of aerosol generating medium 110 and the mouthpiece 130'.

The pressed seal 160 may be formed by the movement of the element 134 against the substrate 150 with the substrate 150 being rigid to provide a force opposing the force supplied by the element 134. In an alternative example, the force against the movement of the element 134 may be provided by the source of energy for heating 120. That is, the element 134 may press the substrate 150 against the source of energy for heating 120. The heater 120 may be dimensioned so as to be corresponding with the cross-section of the element 134. In FIG. 2*a*, for example, the source of energy for heater 120 is smaller than the cross-section of the element 134.

The element 134 when positioned against the substrate 150 as shown in FIG. 2*a*, and forming a heating zone, contacts the substrate 150 only. That is, the element 134 does not touch the portion of aerosol generating medium 110 in the heating zone. The element 134 can be kept cleaner in this way over numerous uses. In an example wherein the aerosol generating medium 110 is even distributed over the substrate 150, the element 134 may be in contact with the aerosol generating medium 110. This may, in turn, increase the lifetime of the device by decreasing the regularity with which the element 134 is replaced.

Also shown in FIG. 2*a*, the heater 120 may be selectively moveable relative to the plurality of sources of aerosol generating medium 110 to selectively heat a selected one of the plurality of sources of aerosol generating medium 110 to form an aerosol. The heater 120 shown in FIG. 2*a* may move along the axis shown by the arrow B. This movement enables the heater 120 to heat any of three shown sources of aerosol generating medium 110. The arrow B is shown to be at an angle to the arrow A along which the relative movement between the mouthpiece 130 and the plurality of sources of aerosol generating medium 110 occurs. Although shown in the example as being perpendicular, this is not a necessity. The directions of movement may be along completely different axes, and may be curved in comparison to one another or the like.

The source of aerosol generating medium 110 may take any suitable form or construction. In one embodiment, the source of aerosol generating medium may include a substrate 150 (for example, paper, card, foil) including a first and second side, with the aerosol generating medium disposed on the first side of the substrate 150. The substrate 150 in this instance may act as a carrier for the aerosol generating medium 110. In some implementations, the substrate 150 may be, or may include, a metallic element that is arranged to be heated by a varying magnetic field. In such implementations, the source of energy for heating 120 may include an induction coil, which, when energised, causes heating within the metallic element of the source 110. The degree of heating may be affected by the distance between the metallic element and the induction coil. In yet further alternative implementations, the source of aerosol generating medium 110 may consist entirely (or substantially entirely) of aerosol generating medium (i.e., without a carrier). For the purposes of describing a concrete example, the source 110 described herein includes a substrate 150 with aerosol generating medium disposed on the first side of the substrate 150, while the source of energy for heating 120 is herein a resistive heater.

Figure 2B:
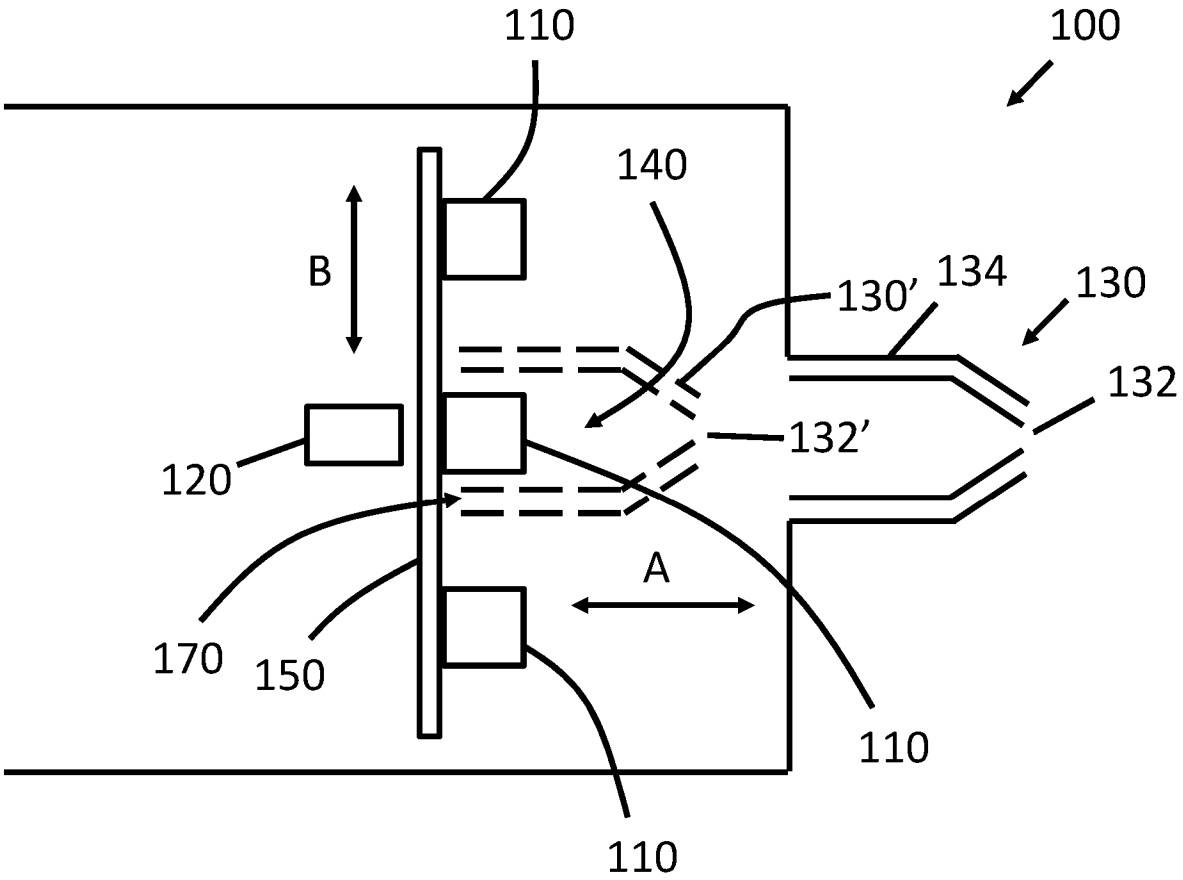
FIG. 2*b* is a schematic sectional view of a portion of an aerosol generating system according to an example.

FIG. 2*b* is a schematic sectional view of a portion of an aerosol generating device 100 according to an example. Reference numerals indicating the same features as shown in FIGS. 1 and 2*a* are the same as those numerals used in FIGS. 1 and 2*a*. These same features will not be discussed in detail here. FIG. 2*b* shows an example of an aerosol generating device 100 that differs from the example of an aerosol generating device 100 shown in FIG. 2*a* by the offset nature of the mouthpiece 130' and the substrate 150.

The mouthpiece 130 in the example of FIG. 2*b* is selectively moveable relative to the plurality of sources of aerosol generating medium 110 to be positioned around the selected one of the plurality of sources of aerosol generating medium 110 and offset from the surface of the substrate 150. In other words, the mouthpiece 130' does not make contact with the substrate 150. The offset 170 enables air to enter the enclosed aerosol generation region 140, between the substrate 150 and the mouthpiece 130', to entrain components from the heated source of aerosol generating medium 110 prior to passing through the outlet 132' of the mouthpiece 130'. Conversely, in the arrangement of FIG. 2*a*, air may enter the chamber 140 via inlets/apertures formed in the wall of the mouthpiece 130 or element 134 (described in more detail below). It should be appreciated that such inlets/apertures may also be present in the implementation shown in FIG. 2*b*.

When the aerosol generating medium 110 is evenly distributed over the substrate 150, the element 134 can be kept cleaner by use of the offset 170 as shown in FIG. 2*b*. By having the element 134 not abut the substrate/aerosol generating medium, the element 134 is kept cleaner which increases the time between replacement of the element 134 and therefore increases the lifetime of the device 100.

The substrate 150 shown in FIGS. 2*a* and 2*b* may move with the plurality of sources of aerosol generating medium 110 relatively to the mouthpiece 130. The substrate 150 may also be made of a thermally conductive material so as to conduct to the plurality of sources of aerosol generating medium 110 from the heater 120, when the heater 120 is arranged on the opposite side of the substrate 150 to the sources of aerosol generating medium 110, as in the examples shown.

The heater 120 may be an electrically resistive heater 120. The heater 120 may be a chemically activated heater which may or may not operate via exothermic reactions or the like. The heater 120 provides thermal energy, heat, to the surrounding environment of the heater 120. At least some portion of the substrate 150 is within the area of effect of the heater 120. The area of effect of the heater 120 is the area within which the heater 120 may provide heat to an item. The source of energy for heating 120 may be part of an inductive heating system, wherein the source of energy for heating 120 is the source of energy for inductive heating and the substrate 150 may be or may contain a susceptor or the like. The susceptor may for example be a sheet of aluminium foil or the like.

Figure 3:
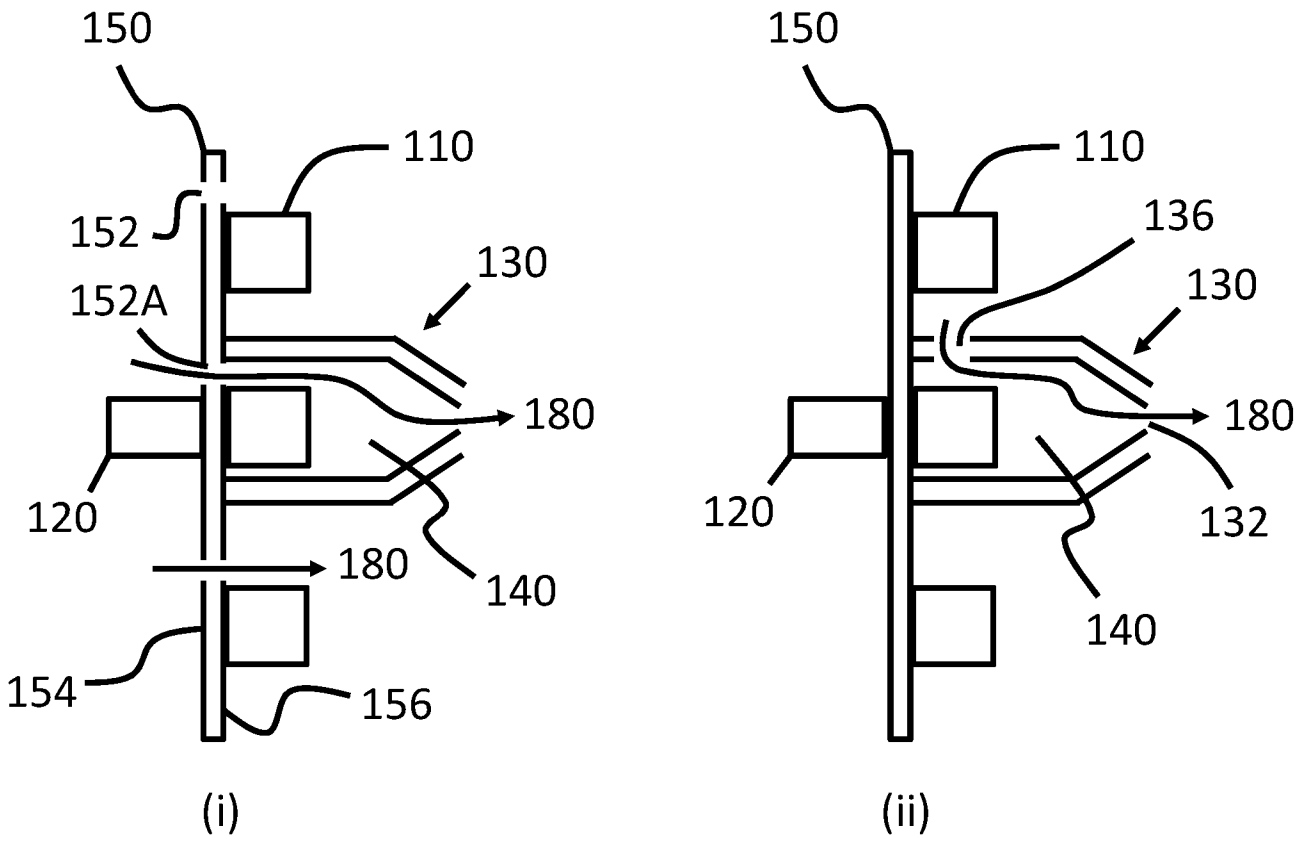
FIG. 3 are schematic views of an aerosol generating system according to two examples; and, FIG. 4 is a schematic sectional view of a mouthpiece and a substrate of an aerosol generating system according to an example.

FIG. 3 shows schematic views of an aerosol generating device according to two examples. Reference numerals indicating the same features as shown in FIGS. 1 and 2*a* are the same as those numerals used in FIGS. 1 and 2*a*. These same features will not be discussed in detail here. In the arrangement, shown in the example of FIG. 3 (*i*), the substrate 150 comprises a plurality of air holes 152 for enabling air to pass from a side of the substrate 154 not facing the mouthpiece 130 to a side 156 of the substrate 150 facing the mouthpiece 130. Air holes 152 located in the substrate 150 enable air flow as shown by arrows 180 through the substrate 150. As shown in FIG. 3 (*i*), air may flow through the specific air hole 152A, past the selected source of aerosol generating medium 110 being heated by heater 120 to entrain components from the heated aerosol generating medium, and subsequently through and out the mouthpiece 130. This aerosol may then be inhaled by a user.

An advantage of the arrangement of FIG. 3 (*i*) is that the air flow may be preheated as it passes the heater 120 prior to passing through specific air hole 152A. In this way, a greater amount of thermal energy will be transferred to the selected source of aerosol generating medium 110 and will decrease the time required to begin vaporization of some of the components of the source of aerosol generating medium 110. In an example, the substrate 150 is made of a porous or an air-permeable material, such that air flow can pass through the substrate 150 as a whole rather than through a specific air hole 152 formed in the substrate 150. In a specific example, the substrate 150 is made of an air-permeable material which only allows air flow to pass when under pressure, such as during inhalation of the user. In an example, the substrate 150 may be formed of a porous layer, for example paper. Air may pass through specific or artificial air holes 152 in the substrate 150, through inherent air holes in the substrate 150 if formed of paper or the like, and through the aerosol generating medium which may be located in the air holes 152 etc. The substrate 110 may contain nicotine, tobacco, or tobacco derivative or the like. The substrate 110 may be formed exclusively of such materials, or be made of more than one such material. The substrate 110 may have a layered structure from a plurality of materials. In one example, the substrate 110 may have a layer of thermally conductive material, inductive material, permeable material or impermeable material.

The device 100 may have in an example substantially the same distance to a mouthpiece and to the heater 120 for providing a more consistent user experience. In an example the aerosol forming material is disposed on the substrate 150 at a distance from the source of energy for heating 120 within the range of 0.010 mm, 0.015 mm, 0.017 mm, 0.020 mm. 0.023 mm, 0.025 mm, 0.05 mm, 0.075 mm, 0.1 mm, to about 4 mm, 3.5 mm, 3 mm, 2.5 mm, 2.0 mm, 1.5 mm, 1.0 mm, 0.5 mm or 0.3 mm. In some cases, there may be a minimum spacing between the source of energy for heating 120 and aerosol forming material on the substrate 150 of at least about 10 μm, 15 μm, 17 μm, 20 μm, 23 μm, 25 μm, 50 μm, 75 μm or 0.1 mm.

FIG. 3 (*ii*) shows a similar arrangement to FIG. 3 (*i*). The arrangement of FIG. 3 (*ii*) differs by the lack of air holes 152 and the presence of air hole 136. In the example shown, the mouthpiece 130 comprises an air hole 136 for enabling air to flow into the mouthpiece 130 to entrain aerosol produced by the source of aerosol generating medium 110. The arrangement of FIG. 3 (*ii*) may be combined with the arrangement of FIG. 3 (*i*). While multiple air holes may be present in the mouthpiece 130, there is no requirement for such. A single air hole 136, which enables air flow into the mouthpiece 130 to entrain components from a heated source of aerosol generating medium 110, enables such an air flow irrelevant of which selected one of the plurality of sources of aerosol generating medium 110 is the source of aerosol generating medium 110 in the aerosol generation region 140. This arrangement may therefore reduce complexity of manufacture of the device 100.

In an example wherein the arrangements of FIG. 3 (*i*) and (*ii*) are used in combination, the pressure of inhalation from a user would substantially prevent air flow incoming through the specific air hole 152A of the substrate 150 and exiting through the air hole 136 of the mouthpiece 130. Additional features such as valves may be used to ensure that air flow passes in the desired manner from near the substrate 150, through the mouthpiece 130 and out the mouthpiece outlet 132. A portion of the flow path 180 is substantially constrained between the mouthpiece 130, the air inlet 136 and the source of aerosol generating medium 110 when the enclosed aerosol generation region 140 is formed.

The examples shown in FIG. 3 (*i*) and (*ii*) show the mouthpiece 130 and the substrate 150 in a pressed seal. This need not be the case. The mouthpiece 130 may be offset from the substrate 150 with air holes 136, 152 present in either the mouthpiece 130 or substrate 150. As described above, valves or the like may be used so that passage of air flow through the mouthpiece 130 occurs as intended. The inlets 136, 152 of the examples shown in FIG. 3 (*i*) and (*ii*) are sized so that the plurality of sources of aerosol generating medium 110 cannot pass through the inlets 136, 152.

Figure 4:
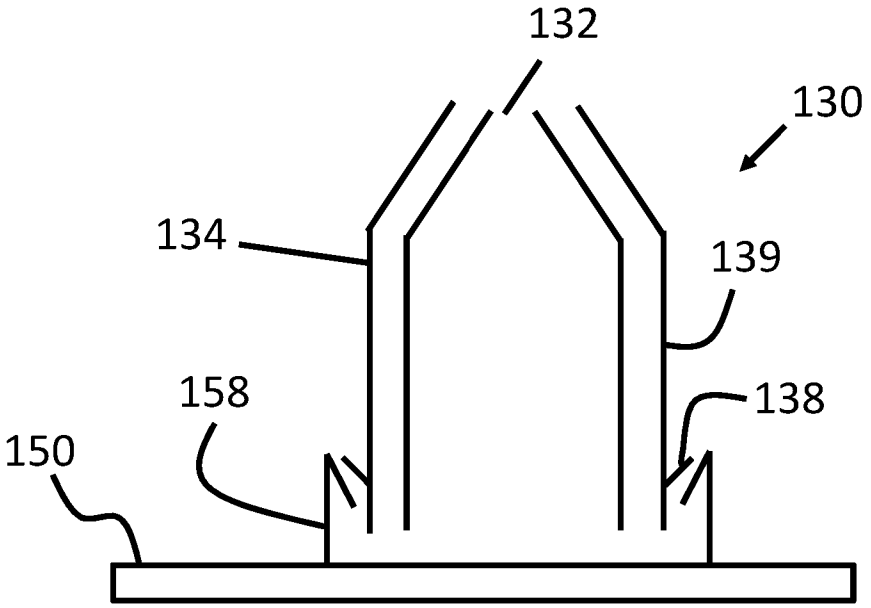

FIG. 4 shows a schematic view of a mouthpiece and a substrate 150 of the device 100. The device 100 may comprise a series of contacting elements to ensure a good fit or connection between the mouthpiece 130 and the substrate 150 or the sources of aerosol generating medium 110. In the simplified view of FIG. 4 (in which there are no sources of aerosol generating medium 110 or air holes 136, 152), the mouthpiece 130 has projections 138 which correspond to projections 158 on the substrate 150. These projections 138, 158 may join together in an interference fit. These projections 138, 158 may be made of any suitable material such as resilient members or snap-lock plastics or the like. The location and sizes of the contacting elements/projections 138, 158 may be selected to result in the pressed seal arrangement of FIG. 2*a* or the offset 170 arrangement of FIG. 2*b*. The contacting elements of the device 100 may be O-rings or the like. The mouthpiece 130 of the device 100 may have a number of projections and the substrate 150 may have a series of recesses for engaging the projections. Additionally or alternatively, a system of grooves and notches may be used. This may also secure the mouthpiece 130 in position during use.

The contacting elements 138 may be arranged on an outer-facing surface of the mouthpiece 130 at a plurality of locations. The locations may vary in distance along the side 139 of the mouthpiece 130. In an example, the contacting elements 138 are present in four equally spaced locations around the outer-facing surface of the side 139 of the mouthpiece 130. These four contacting element locations for contacting elements 138 may correspond to four corresponding contacting element locations for contacting elements 158 on the substrate 150. The contacting elements 158 on the substrate 150 may be positioned around individual sources of aerosol generating medium 110, such that connection between the two sets of four contacting elements 138, 158 secures the mouthpiece 130 around one specific sources of aerosol generating medium 110.

In another example, the contacting elements 138 on the mouthpiece 130 may be one continuous contacting element 138 that covers a portion, or the whole, of the circumference (or the edge or the perimeter) of the outer-facing surface of the side 139 of the mouthpiece 130. This arrangement could assist in retaining the mouthpiece 130 within the device 100 should a user incorrectly attempt to form the aerosol generation region 140 by, e.g., pulling the mouthpiece 130 away from the device 100 rather than pushing into the device 100. The contacting elements 138 may catch on an inner surface of the housing 102 of the device 100 to provide an additional resistance to the user's pulling which may inform the user of incorrect usage of the device 100 if the user is pulling the mouthpiece 130 too far away from the housing 102.

In an example, the plurality of sources of aerosol generating medium 110 is a continuous aerosol generating medium arranged on the substrate 150. In this way, a portion of the aerosol generating medium 110 may be selected by the relative position of the mouthpiece 130 to the substrate 150 and this portion of aerosol generating medium 110 may then be heated by the heater 120 to produce aerosol. In a specific example, the aerosol generating medium 110 may be a tobacco mat arranged on the substrate 150. The relative movement of the mouthpiece 130 to the substrate 150 may be altered between uses of the device 100 to ensure that depleted aerosol generating medium 110 is not heated subsequently. This can lead to the release of undesirable components from the depleted aerosol generating medium 110 which may be inhaled by the user.

In an example, the device 100 comprises a movement element to enable relative movement between the mouthpiece 130 and the source of aerosol generating medium 110. The movement element may be at least one of a biased member or a rotational movement to axial movement converter, etc. For example, prior to use of the device 100 the user may turn, rotate or screw the mouthpiece 130 so as to move the mouthpiece 130 to form an enclosed aerosol generation region 140 around a selected one of the plurality of sources of aerosol generating medium 110. That is to say that in examples of the device 100 there may be some rotational motion to translational motion converter attached to the mouthpiece 130. In an example, the mouthpiece 130 may be screwed by e.g. 90° to form the aerosol generation region 140. The quarter turn may be more or less based on implementation. In an example, the mouthpiece 130 may have a biased member arranged such that when the user places the mouthpiece 130 in their mouth, the mouthpiece 130 is moved against the bias of the biased member into the device 100 to form the aerosol generation region 140. The mouthpiece 130 may be on runners or tracks or the like, as mentioned above, to greater control the movement of the mouthpiece 130 into the device 100. Runners, or the like, may ensure the mouthpiece 130 consistently moves a predetermined distance into the device 100 to consistently and reliably form the enclosed aerosol generation region 140. Use of runners, or the like, would lessen the likelihood of the mouthpiece 130 not moving far enough into the device 100 and therefore not forming the aerosol generation region 140 or moving too far and dislodging or damaging components within the device 100. When the use session is finished and the user removes the mouthpiece 130 from their mouth, the mouthpiece 130 under the action of the biased member may return to the at rest position, wherein the mouthpiece 130 does not form the aerosol generation region 140.

Additionally or alternatively, the plurality of sources of aerosol generating medium 110 may have a similar movement mechanism which may take the form of biased members, or motors and shafts, or projections for projecting the selected source of aerosol generating medium 110 towards the mouthpiece 130 or the like. For the avoidance of doubt, any of the above described components for providing relative movement of the sources of aerosol generating medium 110 to the mouthpiece 130 may be used on either or both of the sources of aerosol generating medium 110 and the mouthpiece 130.

The relative movement between the plurality of sources of aerosol generating medium 110 and the mouthpiece 130 may occur in response to a user action, as described in the specific example above. The action may be a physical action such as pushing, pulling or twisting a component of the device 100 or may be e.g. puffing on the device 100 which could be detected by a puff detector which subsequently results in some structural change in the device 100. Alternatively, or additionally, the action may be inputting a command into the device 100, which is then acted upon by a controller of the device 100, such as pushing an activation button.

The plurality of sources of aerosol generating medium 110 may be moved in between uses of the device 100 or as one selected source of aerosol generating medium 110 is depleted. This movement may be a linear movement or a rotational movement. The sources of aerosol generating medium 110 may be moved by a rotating gear and shaft arrangement or a system of cams or a Geneva wheel or the like. In the example wherein the mouthpiece 130 is not in contact with the sources of aerosol generating medium 110 at rest, the sources of aerosol generating medium 110 may be moved without acting against the mouthpiece 130. In the example wherein the plurality of sources of aerosol generating medium 110 are on a substrate 150, the substrate 150 may be rotated, or in any other manner moved, to affect movement of the sources of aerosol generating medium 110.

In use, the aerosol generated from heating of the source of aerosol generating medium 110 is restricted to within the aerosol generation region 140. This prevents the aerosol from condensing on other areas within the device 100 or on components other than the mouthpiece 130. Aerosol can damage components by condensing on them and this may then impact the lifetime of components. The lifetime of the device 100 as a whole is increased by virtue of the restricted condensing region for aerosol within the device 100, i.e. between the selected source of aerosol generating medium 110, the mouthpiece 130 and the outlet 132 of the mouthpiece 130. The mouthpiece 130 may be removable and replaceable such that, after a predetermined number of uses, the mouthpiece 130 is removed and replaced, simultaneously removing condensed aerosol from the inside surface of the mouthpiece 130. This increases the overall cleanliness of the device 100.

The heater 120 may be moved into an aerosol generating position, i.e. near a selected source of aerosol generating medium 110 prior to or on initiation of a smoking session. The movement of the heater 120 may be automated or may occur on user request. The automation of the movement of the heater 120 may be achieved using, for example, a puff detector. Upon detection of a puff by the user, the heater 120 may be moved from an aerosol generating position near the previously heated selected source of aerosol generating medium 110 to the aerosol generating position near the to-be heated selected source of aerosol generating medium 110.

The device 100 may have detectors or sensors located in, for example, the mouthpiece 130 of the device 100 such that when the user places the device 100 in their mouth, the heater 120 is moved from a previous aerosol generating position to the presently required aerosol generating position. Alternatively, the mouthpiece 130 could be movable so as to affect movement in the heater 120. The mouthpiece 130 may have a responsive element, such as a biased member, such as a tensioned spring, which is affected by placement of the mouthpiece 130 into the user's mouth which provides movement, directly or indirectly, to the heater 120. The device 100 may alternatively or additionally have a button, or the like, which a user may press to instruct the movement of the heater 120 from a previous aerosol generating position to the new aerosol generating position. Activation of the heater 120 may occur prior to, in tandem with, or with a delay from, the movement of the heater 120.

A source of the plurality of sources of aerosol generating medium 110 may comprise a single dose of aerosol generating material or a plurality of doses of aerosol generating material. In implementations with a plurality of doses, each dose may be separately heatable to produce a predetermined amount of aerosol per use. The doses may be arranged on a base or the substrate 150 of the source of aerosol generating medium 110 so as to be individual and separate within or on the source of aerosol generating medium 110 or may overlap or be adjacent (i.e., the different does may comprise different areas of a single region of aerosol generating material).

Each of the plurality of doses may be separately heatable by relative movement between the heater 120 and the doses of aerosol generating material to align different doses with the heater 120 at different times. The source of aerosol generating medium 110 may rotate about a central axis to present a different portion of the source of aerosol generating medium 110 to the heater 120. This may correspond to different doses of the source of aerosol generating medium 110 being heated, which may correspond to different aerosol generating media, such as tobacco or menthol or the like. This enables the device 100 to provide a number of different user experiences. The source of aerosol generating medium 110 may be moved by any of the methods or components described herein in relation to movement of the heater 120.

The source of aerosol generating medium 110 or the doses contained within the source of aerosol generating medium 110 may comprise at least one of tobacco and glycol and may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, pigment, ginger, anise, coriander, coffee, or a mint oil from any species of the genus *Mentha*), flavour enhancers, bitterness receptor site blockers, sensorial receptor site activators or stimulators, sugars or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. The doses may be separated, adjacent or overlapping.

The aerosol-forming layer described herein comprises an "amorphous solid", which may alternatively be referred to as a "monolithic solid" (i.e., non-fibrous), or as a "dried gel". The amorphous solid is a solid material that may retain some fluid, such as liquid, within it. In some cases, the aerosol-forming layer comprises from about 50 wt %, 60 wt % or 70 wt % of amorphous solid, to about 90 wt %, 95 wt % or 100 wt % of amorphous solid. In some cases, the aerosol-forming layer consists of amorphous solid.

In some cases, the amorphous solid may comprise 1-50 wt % of a gelling agent wherein these weights are calculated on a dry weight basis.

Suitably, the amorphous solid may comprise from about 1 wt %, 5 wt %, 10 wt %, 15 wt %, 20 wt % or 25 wt % to about 50 wt %, 45 wt %, 40 wt %, 35 wt %, 30 wt % or 27 wt % of a gelling agent (all calculated on a dry weight basis). For example, the amorphous solid may comprise 5-40 wt %, 10-30 wt % or 15-27 wt % of a gelling agent.

In some embodiments, the gelling agent comprises a hydrocolloid. In some embodiments, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate or pectin, and may be combined with a setting agent (such as a calcium source) during formation of the amorphous solid. In some cases, the amorphous solid may comprise a calcium-crosslinked alginate or a calcium-crosslinked pectin.

Suitably, the amorphous solid may comprise from about 5 wt %, 10 wt %, 15 wt %, or 20 wt % to about 80 wt %, 70 wt %, 60 wt %, 55 wt %, 50 wt %, 45 wt % 40 wt %, or 35 wt % of an aerosol generating agent (all calculated on a dry weight basis). The aerosol generating agent may act as a plasticiser. For example, the amorphous solid may comprise 10-60 wt %, 15-50 wt % or 20-40 wt % of an aerosol generating agent. In some cases, the aerosol generating agent comprises one or more compound selected from erythritol, propylene glycol, glycerol, triacetin, sorbitol and xylitol. In some cases, the aerosol generating agent comprises, consists essentially of or consists of glycerol. The inventors have established that if the content of the plasticiser is too high, the amorphous solid may absorb water resulting in a material that does not create an appropriate consumption experience in use. The inventors have established that if the plasticiser content is too low, the amorphous solid may be brittle and easily broken. The plasticiser content specified herein provides an amorphous solid flexibility which allows the amorphous solid sheet to be wound onto a bobbin, which is useful in manufacture of aerosol generating articles.

In some cases, the amorphous solid may comprise a flavour. Suitably, the amorphous solid may comprise up to about 60 wt %, 50 wt %, 40 wt %, 30 wt %, 20 wt %, 10 wt % or 5 wt % of a flavour. In some cases, the amorphous solid may comprise at least about 0.5 wt %, 1 wt %, 2 wt %, 5 wt % 10 wt %, 20 wt % or 30 wt % of a flavour (all calculated on a dry weight basis). For example, the amorphous solid may comprise 10-60 wt %, 20-50 wt % or 30-40 wt % of a flavour. In some cases, the flavour (if present) comprises, consists essentially of or consists of menthol. In some cases, the amorphous solid does not comprise a flavour.

In some cases, the amorphous solid additionally comprises a tobacco material or nicotine. For example, the amorphous solid may additionally comprise powdered tobacco or nicotine or a tobacco extract. In some cases, the amorphous solid may comprise from about 1 wt %, 5 wt %, 10 wt %, 15 wt %, 20 wt % or 25 wt % to about 70 wt %, 60 wt %, 50 wt %, 45 wt % or 40 wt % (calculated on a dry weight basis) of a tobacco material or nicotine.

In some cases, the amorphous solid comprises a tobacco extract. In some cases, the amorphous solid may comprise 5-60 wt % (calculated on a dry weight basis) of tobacco extract. In some cases, the amorphous solid may comprise from about 5 wt %, 10 wt %, 15 wt %, 20 wt % or 25 wt % to about 55 wt %, 50 wt %, 45 wt % or 40 wt % (calculated on a dry weight basis) tobacco extract. For example, the amorphous solid may comprise 5-60 wt %, 10-55 wt % or 25-55 wt % of tobacco extract. The tobacco extract may contain nicotine at a concentration such that the amorphous solid comprises 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the amorphous solid other than that which results from the tobacco extract.

In some embodiments the amorphous solid comprises no tobacco material but does comprise nicotine. In some such cases, the amorphous solid may comprise from about 1 wt %, 2 wt %, 3 wt % or 4 wt % to about 20 wt %, 15 wt %, 10 wt % or 5 wt % (calculated on a dry weight basis) of nicotine. For example, the amorphous solid may comprise 1-20 wt % or 2-5 wt % of nicotine.

In some cases, the total content of tobacco material, nicotine and flavour may be at least about 1 wt %, 5 wt %, 10 wt %, 20 wt %, 25 wt % or 30 wt %. In some cases, the total content of tobacco material, nicotine and flavour may be less than about 70 wt %, 60 wt %, 50 wt % or 40 wt % (all calculated on a dry weight basis).

In some embodiments, the amorphous solid is a hydrogel and comprises less than about 20 wt % of water calculated on a wet weight basis. In some cases, the hydrogel may comprise less than about 15 wt %, 12 wt % or 10 wt % of water calculated on a wet weight basis (WWB). In some cases, the hydrogel may comprise at least about 2 wt % or at least about 5 wt % of water (WWB).

The amorphous solid may be made from a gel, and this gel may additionally comprise a solvent, included at 0.1-50 wt %. However, the inventors have established that the inclusion of a solvent in which the flavour is soluble may reduce the gel stability and the flavour may crystallise out of the gel. As such, in some cases, the gel does not include a solvent in which the flavour is soluble.

The amorphous solid comprises less than 20 wt %, suitably less than 10 wt % or less than 5 wt % of a filler. The filler may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In some cases, the amorphous solid comprises less than 1 wt % of a filler, and in some cases, comprises no filler. In particular, in some cases, the amorphous solid comprises no calcium carbonate such as chalk.

In some cases, the amorphous solid may consist essentially of, or consist of a gelling agent, an aerosol generating agent, a tobacco material or a nicotine source, water, and optionally a flavour.

In the examples above, the source of aerosol generating medium 110 or the substrate 150 may have a base or coating or the like, which is substantially impermeable to aerosol. This arrangement may encourage the aerosol generated from heating of the source of aerosol generating medium 110 to flow away from the heater 120 and towards the mouthpiece outlet 132. This can help reduce the likelihood of condensation of aerosol within the device 100 but not within the mouthpiece 130 and, as mentioned above, therefore increases both the cleanliness and lifetime of the device 100. The base may be formed of at least one of materials such as paper, card, foil and the like.

Thus there has been described an aerosol generating device comprising: a plurality of sources of aerosol generating medium; a heater for selectively heating a selected one of the plurality of sources of aerosol generating medium to form an aerosol; and, a mouthpiece, wherein the mouthpiece is selectively moveable relative to the plurality of sources of aerosol generating medium to form an enclosed aerosol generation region around the selected one of the plurality of sources of aerosol generating medium as it is heated.

The aerosol provision system may be used in a tobacco industry product, for example a non-combustible aerosol provision system.

In one embodiment, the tobacco industry product comprises one or more components of a non-combustible aerosol provision system, such as a heater and an aerosolizable substrate.

In one embodiment, the aerosol provision system is an electronic cigarette also known as a vaping device.

In one embodiment the electronic cigarette comprises a heater, a power supply capable of supplying power to the heater, an aerosolizable substrate such as a liquid or gel, a housing and optionally a mouthpiece.

In one embodiment the aerosolizable substrate is contained in or on a substrate container. In one embodiment the substrate container is combined with or comprises the heater.

In one embodiment, the tobacco industry product is a heating product which releases one or more compounds by heating, but not burning, a substrate material. The substrate material is an aerosolizable material which may be for example tobacco or other non-tobacco products, which may or may not contain nicotine. In one embodiment, the heating device product is a tobacco heating product.

In one embodiment, the heating product is an electronic device.

In one embodiment, the tobacco heating product comprises a heater, a power supply capable of supplying power to the heater, an aerosolizable substrate such as a solid or gel material.

In one embodiment the heating product is a non-electronic article.

In one embodiment the heating product comprises an aerosolizable substrate such as a solid or gel material, and a heat source which is capable of supplying heat energy to the aerosolizable substrate without any electronic means, such as by burning a combustion material, such as charcoal.

In one embodiment the heating product also comprises a filter capable of filtering the aerosol generated by heating the aerosolizable substrate.

In some embodiments the aerosolizable substrate material may comprise an aerosol or aerosol generating agent or a humectant, such as glycerol, propylene glycol, triacetin or diethylene glycol.

In one embodiment, the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment, the hybrid system comprises a liquid or gel substrate and tobacco.

In order to address various issues and advance the art, the entirety of this disclosure shows by way of illustration various embodiments in which the disclosure may be practiced and provide for a superior electronic aerosol provision system. The advantages and features of the disclosure are of a representative sample of embodiments only, and are not exhaustive or exclusive. They are presented only to assist in understanding and teach the claimed features. It is to be understood that advantages, embodiments, examples, functions, features, structures, or other aspects of the disclosure are not to be considered limitations on the disclosure as defined by the claims or limitations on equivalents to the claims, and that other embodiments may be utilised and modifications may be made without departing from the scope or spirit of the disclosure. Various embodiments may suitably comprise, consist of, or consist essentially of, various combinations of the disclosed elements, components, features, parts, steps, means, etc. In addition, the disclosure includes other embodiments not presently claimed, but which may be claimed in future.

The invention claimed is:

1. An aerosol generating system comprising:

an aerosol generating medium;

a source of energy for heating for selectively heating in a heating zone associated with the source of energy for heating portions of aerosol generating medium to form an aerosol;

an outlet through which aerosol can flow to exit the device; and a selectively moveable element, wherein the element is selectively moveable relative to the aerosol generating medium to form a substantially enclosed chamber around the heating zone, and in fluid communication with the outlet, wherein the outlet and the selectably moveable element are in the form of a mouthpiece and wherein the mouthpiece is removable and wherein the aerosol generating system is a hybrid system comprising a liquid aerosol generating medium and a solid aerosol generating system.

2. The aerosol generating system according to claim 1, wherein the aerosol generating medium is arranged on a substrate, and wherein the element is selectively moveable relative to the aerosol generating medium to be positioned around a portion of aerosol generating medium and not abutting the substrate.

3. The aerosol generating system according to claim 1, wherein the device comprises a movement element to enable relative movement between the element and the aerosol generating medium, the movement element being at least one of:

a biased member; or a rotational movement to axial movement converter.

4. The aerosol generating system according to claim 1, wherein relative movement between the aerosol generating medium and the element occurs in response to a user action.

5. The aerosol generating system according to claim 1, wherein a portion of aerosol generating medium comprises a plurality of doses of aerosol generating medium.

6. The aerosol generating system according to claim 1, wherein the source of energy for heating is selectively moveable relative to the aerosol generating medium to selectively heat a selected portion of aerosol generating medium to form an aerosol.

7. The aerosol generating system according to claim 1, wherein the direction of relative moment between the element and the aerosol generating medium is in the axis of aerosol flow from aerosol generating medium to the outlet.

8. The aerosol generating system according to claim 1, wherein the aerosol generating medium is arranged on a substrate, and wherein the element is selectively moveable relative to the aerosol generating medium to form a pressed seal around a portion of aerosol generating medium on the substrate.

9. The aerosol generating system according to claim 8, wherein the substrate comprises a plurality of air holes for enabling air to pass from a side of the substrate not facing the outlet to a side of the substrate facing the outlet.

10. The aerosol generating system according to claim 8, wherein the element comprises an air hole for enabling air to flow into the heating zone to entrain aerosol produced by the portion of aerosol generating medium in the heating zone.

11. The aerosol generating system according to claim 8, wherein the aerosol generating medium is a continuous aerosol generating medium arranged on the substrate.

12. The aerosol generating system according to claim 8, wherein the element has a contacting element and each of the portions of aerosol generating medium has a corresponding contacting element, wherein the contacting element of the element contacts the contacting element of the portion of aerosol generating medium to secure the element and the portion of aerosol generating medium to form the heating zone around the portion of aerosol generating medium.

13. The aerosol generating system according to any of claim 12, wherein the element does not touch the substrate.

14. Aerosol generating means comprising:

aerosol generating means;

heating means for selectively heating in a heating zone associated with the heating means portions of aerosol generating means to form an aerosol;

outlet means through which aerosol can flow; and, a selectively moveable means, wherein the selectively moveable means is selectively moveable relative to the aerosol generating means to form a substantially enclosed chamber around the heating zone, and in fluid communication with the outlet means, wherein the outlet means and the selectively movable means are in the form of a mouthpiece and wherein the mouthpiece is removable, and wherein the aerosol generating means is a hybrid means comprising a liquid aerosol generating means and a solid aerosol generating means.

15. An aerosol generating device configured to receive aerosol generating medium, comprising:

a source of energy for heating for selectively heating, in use, portions of aerosol generating medium to form an aerosol;

an outlet; and a selectively moveable element, wherein the element is selectively moveable relative to the aerosol generating medium to, in use, form a substantially enclosed chamber around the heating zone, and in fluid communication with the outlet, wherein the outlet and the selectively movable element are in the form of a mouthpiece and wherein the mouthpiece is removable, and wherein the aerosol generating device is a hybrid aerosol generating device configured to receive a liquid aerosol generating medium and a solid aerosol generating medium.

* * * * *